United States Patent [19]

Hirsch et al.

[11] 4,298,816

[45] Nov. 3, 1981

[54] MOLYBDENUM SUBSTRATE FOR HIGH POWER DENSITY TUNGSTEN FOCAL TRACK X-RAY TARGETS

[75] Inventors: Harold H. Hirsch; Melvin R. Jackson, both of Schenectady, N.Y.

[73] Assignee: General Electric Company, Schenectady, N.Y.

[21] Appl. No.: 109,163

[22] Filed: Jan. 2, 1980

[51] Int. Cl.[3] ..... H01J 35/10

[52] U.S. Cl. ..... 313/330; 313/60

[58] Field of Search ..... 313/330, 311, 55, 60; 76/126 C, 176

[56] References Cited

U.S. PATENT DOCUMENTS

| | | | |
|---|---|---|---|
| 3,836,807 | 9/1974 | Schreiner et al. | 313/330 |
| 3,869,634 | 3/1975 | Konieczynski et al. | 313/330 |
| 4,000,434 | 12/1976 | Schreiner et al. | 313/330 |
| 4,073,426 | 2/1978 | Devine, Jr. | 228/122 |
| 4,195,247 | 3/1980 | Hirsch | 313/330 |

*Primary Examiner*—Eugene R. LaRoche

*Attorney, Agent, or Firm*—Stephen S. Strunck; James C. Davis, Jr.; Leo I. MaLossi

[57] ABSTRACT

Improved rotary targets for X-ray tubes are provided which include a substrate body of a high strength molybdenum alloy, an intermediate ductile layer of pure molybdenum or a ductile molybdenum alloy affixed to the top surface thereof and an electron receiving layer made of a tungsten-based alloy affixed to at least a portion of the intermediate layer.

6 Claims, 1 Drawing Figure

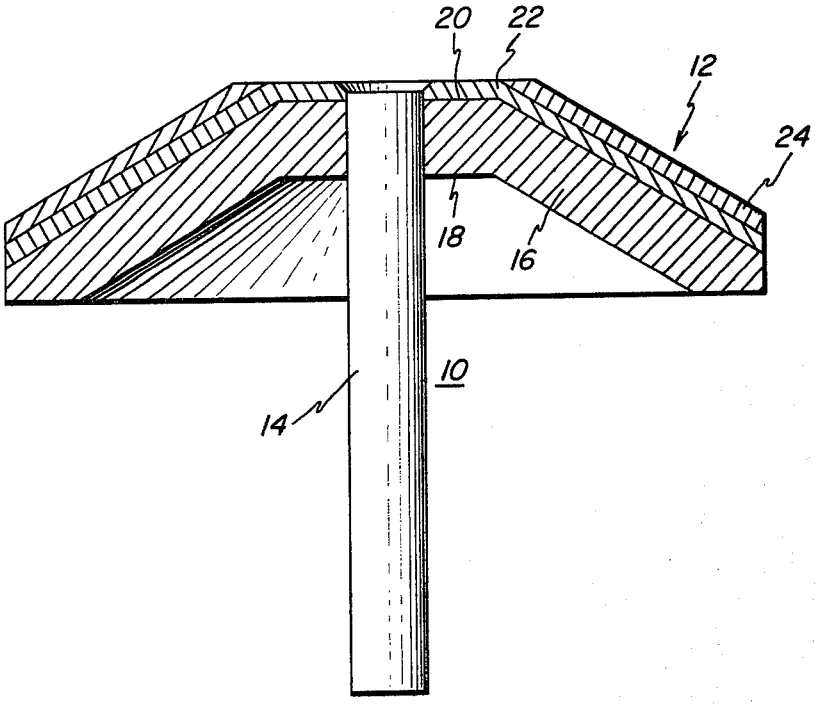
20
22
12
24
18
16
10
14

MOLYBDENUM SUBSTRATE FOR HIGH POWER DENSITY TUNGSTEN FOCAL TRACK X-RAY TARGETS

BACKGROUND OF THE INVENTION

In X-ray equipment, various means are used to bombard electrons onto a positively charged surface, referred to as an anode or an X-ray target, and thereby generate the X-rays. There are both stationary and rotating targets available commercially. The focal track is the portion of the surface of the target that is bombarded by the electrons.

Tungsten alone or tungsten alloyed with other metals are commonly used in X-ray targets. Metals which are sometimes alloyed with the tungsten are small amounts for example of rhenium, osmium, irridium, platinum, technetium, ruthenium, rhodium and palladium. X-ray targets formed wholly from tungsten alone, or tungsten alloys where tungsten is the predominant metal are undesirable because of the high density and weight of the tungsten. In addition, tungsten is notch sensitive and extremely brittle and is thereby subject to catastrophic failure with resultant damage to the usually delicate equipment with which the target is used, and possible injury to the patient or personnel using the equipment.

Because of the shortcoming of targets made wholly of tungsten alloys which contain relatively expensive alloying elements, attempts have been made to use tungsten or tungsten alloys only for the focal track layer of the target and to support this track on a substrate that is compatible with tungsten and at the same time is less susceptible to cracking, is of a lower density and if possible less costly. For the material to be compatible it must not melt or rapidly alloy with tungsten at the sintering temperature, it should match the coefficient of thermal expansion of tungsten as closely as possible, its pressing and sintering characteristics should also closely match those of the tungsten alloy powder and finally it must have good thermal conductivity. Unalloyed molybdenum meets all these requirements but it is not sufficiently strong at the elevated operating temperatures to always prevent warping and distortion of the tungsten focal track. If this distortion is severe enough a point will be reached at which the X-rays generated on the face of the focal track are no longer directed towards the X-ray emission window very specifically located in the wall of the X-ray tube. If this warpage continues, it eventually leads to an unacceptable drop-off in X-ray output. Molybdenum, however, is ductile and tough enough to nearly always resist extensions of cracks that inevitably form in the tungsten focal track layer due to the excessive thermal stresses imposed therein by the high energy electron bombardment. What is required, therefore, is a way of stiffening the molybdenum substrate without sacrificing its resistance to crack propagation and its other desirable properties.

SUMMARY OF THE INVENTION

In accordance with the present invention we have discovered an improved rotating X-ray target which includes a substrate body of a high strength molybdenum alloy, an intermediate ductile layer of pure molybdenum or a ductile molybdenum alloy affixed to the other surface of the substrate body and an electron receiving layer (i.e. the focal track) made of a tungsten based alloy affixed to at least a portion of the intermediate layer. The unique feature of our invention is that the growth of cracks, which can originate in the focal track layer upon exposure to high energy electrons, is terminated in the intermediate ductile layer and thereby such cracks are prevented from entering and propagating through the substrate layer. In addition, the high strength molybdenum alloy which comprises a substantial portion of the substrate body prevents distortion and warping of the target and, in particular the focal track layer.

BRIEF DESCRIPTION OF THE DRAWING

The invention is more clearly understood from the following description taken in conjunction with the accompanying drawing which is an elevation view, in cross section, of a rotating target of the present invention.

DESCRIPTION OF THE PREFERRED EMBODIMENT

Referring now to the drawing, there is shown an anode assembly 10 suitable for use in a rotating X-ray anode tube. The anode assembly 10 includes a disk 12 joined to a stem 14 by suitable means such, for example, as by diffusion bonding, welding, mechanical joining and the like. The disk 12 comprises a substrate body 16 of a high strength molybdenum alloy and has two opposed major surfaces 18 and 20 which comprise the opposed surfaces of the substrate body 16. An intermediate ductile layer 22 of pure molybdenum or a ductile molybdenum alloy (different from the substrate body alloy) is affixed to surface 20 of the substrate body 16. Having selected a molybdenum alloy for body 16 with a 0.2% yeild strength at 1100° C. of at least about 9,000 psi when tested in vacuum, the intermediate layer should have a ductility of greater than 1.3% total elongation or 1.3% reduction in area over the range of 25°–1100° C.

The focal track or anode target 24 is affixed to and over at least a portion of intermediate layer 22. Other geometric configurations combining target, body and intermediate layer will be obvious to those skilled in the art, however in each instance the intermediate layer 22 will extend under the full extent of the focal track layer.

The material for the focal track layer 24 is either tungsten or an alloy of tungsten and rhenium. The rhenium content may vary up to about 25 weight percent, but is typically from 3 to 10 weight percent. Generally, the focal track layer 24 has a thickness of 0.5–3 mm and the preferred thickness is about 1 to 1.5 mm.

The substrate body 16 is formed from a molybdenum based alloy such as disclosed in the copending application of Hirsch, U.S. patent application Ser. No. 927,290 filed July 24, 1978, now U.S. Pat. No. 4,195,247 and assigned to the assignee of the present invention. Some examples of the molybdenum alloys possessing high yield strengths at 1100° C. are given in Table I.

TABLE I

1100° C. Tensile Data on Pressed, Sintered, Hot Swaged and Annealed Molybdenum Rods

| Weight Percent Alloy Addition | 0.2% Y.S.-ksi | U.T.S. ksi | % Total Elongation |
|---|---|---|---|
| Unalloyed Moly | 5.7 | 9–12 | 33 |
| 0.02 C | 6.8 | 13 | 60 |
| 2¼Ta | 10 | 19 | 28 |
| 1-$Y_2O_3$ | 7.6 | 14 | 45 |
| 0.5 Ti,0.1 Zr,0.05 C | 11.5 | 25 | 26 |
| 0.125 Co | 14 | 26 | 69 |
| 0.125 Fe | 11 | 19 | 43 |

TABLE I-continued

| 1100° C. Tensile Data on Pressed, Sintered, Hot Swaged and Annealed Molybdenum Rods | | | |
|---|---|---|---|
| Weight Percent Alloy Addition | 0.2% Y.S.-ksi | U.T.S. ksi | % Total Elongation |
| 0.25 Fe | 14.5 | 25 | 60 |
| 0.1 Si | 15.5 | 25 | 55 |
| 0.9 Hf | 10 | 20 | 18 |
| 0.5 Ti,0.1 Zr,0.1 C | 49 | 52.5 | 7 |
| 0.6 HfC | 41 | 48 | 8.8 |

In these alloys molybdenum is alloyed with about 0.05–10% weight of a member selected from the group consisting of iron, silicon, carbon, cobalt, tantalum, niobium, hafnium and stable metal oxides or mixtures thereof. Exemplary of suitable stable metal oxides are the oxides of thorium, zirconium, titanium, aluminum, magnesium, yttrium, cerium and the other rare earth metals. Generally the substrate body 16 has a thickness of about 4–25 mm with the preferred thickness range being about 10 to 25 mm.

The intermediate layer as has been mentioned above is composed of substantially pure molybdenum which has the physical properties of being tough and ductile or a molybdenum alloy showing such properties over the entire temperature range of operation of the targets. Examples of five alloys that possess good ductility (better than unalloyed molybdenum) at room temperature are given in Table II. Many of the other alloys listed at the bottom of this table, while possessing good high temperature strengths obviously do not have satisfactory room temperature ductility. Generally, the intermediate ductile layer 22 has a thickness of about 1–5 mm. Individual materials in Table II, which are separated by semicolons, represent different alloys with molybdenum.

TABLE II

| Room Temperature Tensile Tests On Pressed, Sintered Hot Swaged and Annealed Molybdenum Rods | | | | |
|---|---|---|---|---|
| Weight Percent Alloy Addition | 0.2% Y.S. ksi | U.T.S. ksi | Total % Elongation | % Red. in Area |
| Unalloyed Mo | 39 | 51 | 1.3 | 2 |
| 0.6 HfC | 41 | 67 | 8.5 | 8 |
| 0.060 + 0.125 Co | 43 | 64 | 7.0 | 11 |
| 0.02C | 45 | 66 | 5.8 | 5 |
| 1 Ti | 40 | 46 | 5.3 | 1.8 |
| 0.5 Ti + 0.1 Zr + 0.05C | 41 | 54 | 2.2 | 2.6 |
| 1.25 Ta; 0.5 Ti;0.1Zr; 0.125 Fe;1.5 MgO; 0.5 Ti +0.1Zr +0.1C | | | 1.5–2.1 | |
| 0.125 Co; 0.25 Fe; 0.1 Si;5 W;0.5 & 1 $Y_2O_3$;0.9 Hf | | | << 1% Elongation and Reduction in Area | |

The rotating target can be formed by powder metallurgy techniques where layers to form the target layer 24, the intermediate ductile layer 22 and the substrate body layer 16 are placed in a suitable form, pressed and then sintered. Subsequently the sintered compact is subjected to a forging and shaping operation to provide the shape and dimensions of the X-ray target.

The novel three layer targets prepared according to our invention solves a problem arising in the prior art devices which is largely due to cracks that develop in the focal track during repeated thermal shock which is caused by the extremely rapid heating up of this surface layer at a temperature close to its melting point every time the electron bombardment is initiated. These cracks will propagate into the supporting molybdenum substrate unless this substrate is ductile and tough enough to resist further crack growth. If cracks do penetrate the substrate, early failure of the target results due to unbalancing forces that cause wobbling of the revolving target (which rotates at high speeds, up to 10,000 rpm). If allowed to continue, such wobbling eventually causes destruction of the target and tube.

Our invention is further illustrated by the following example:

A three layer target is made using a round bore die. A first thin layer of the tungsten-rhenium powder containing 5 percent by weight of rhenium for the focal track layer is poured into the die and leveled to produce a final thickness of 1–1.75 mm. A second powder of molybdenum metal is poured on the first layer in an amount to provide a final layer having a minimum thickness of 1 mm and this powder is leveled. Thereafter a third powder of a strong molybdenum alloy consisting of molybdenum and 0.125% by weight of iron is poured on the second layer in the die to provide a final layer having a thickness of about 10 mm.

This three layer system is pressed using pressures in the range of 15 to 35 tons per square inch. The pressed compact is sintered in hydrogen at an elevated temperature preferably above 2000° C. The sintered part is hot forged and machined to provide the final target shape and the finished product. A number of targets have been successfully made by this procedure without encountering any difficulties.

It will be appreciated that the invention is not limited to the specific details shown in the examples and illustrations and that various modifications may be made within the ordinary skill in the art without departing from the spirit and scope of the invention.

We claim as our invention:

1. An improved three-layer rotary X-ray target consisting of a substrate body of a molybdenum alloy having a high strength at the elevated operating temperature of the target, an intermediate ductile layer of molybdenum or a ductile molybdenum alloy, and a focal track target layer of a tungsten based alloy, said intermediate layer being contiguous with said substrate body and being situate at least in part between said substrate and said target layer, said molybdenum alloy of said substrate being characterized by a 0.2% yield strength at 1100° C. of at least 9000 psi and said molybdenum or ductile molybdenum alloy of said intermediate layer being characterized by a total elongation or reduction in area over the range of 25°–1100° C. of at least 1.3%, whereby the growth of cracks which originate in said focal track layer upon extended exposure to high energy electrons are terminated in said ductile intermediate layer and are prevented thereby from entering and propagating through said substrate body.

2. The device of claim 1, wherein said tungsten based alloy consists essentially of tungsten and 3–10 percent by weight of rhenium.

3. The device of claim 2, wherein said substrate body consists essentially of a high strength alloy of molybdenum and about 0.05–10 percent by weight of a member selected from the group consisting of (a) a metal selected from the group consisting of iron, cobalt, tantalum, niobium, silicon, carbon and hafnium, and (b) an oxide of a metal selected from the group consisting of thorium, zirconium, titanium, aluminum, magnesium, silicon, yttrium, cerium, and the rare earth metals, and (c) mixtures of said metal, said oxide of a metal, and combinations thereof.

4. The device of claim 3, wherein said intermediate ductile layer is molybdenum.

5. The device of claim 1, wherein said substrate body has a thickness of about 4–25 mm, said intermediate ductile layer has a thickness of about 1–5 mm, and said focal track has a thickness of about 0.5–3 mm.

6. The device of claim 5, wherein said substrate body consists essentially of molybdenum plus 0.125 weight percent iron and has a thickness of about 8–15 mm, said intermediate ductile layer consists of molybdenum and has a thickness of about 2–3 mm, and said focal track consists essentially of tungsten and 5 percent by weight of rhenium and has a thickness of about 0.50–1.5 mm.

* * * * *

UNITED STATES PATENT AND TRADEMARK OFFICE

CERTIFICATE OF CORRECTION

PATENT NO. : 4,298,816
DATED : November 3, 1981
INVENTOR(S) : Harold H. Hirsch
Melvin R. Jackson It is certified that error appears in the above—identified patent and that said Letters Patent is hereby corrected as shown below:

col. 2, line 33, delete "yeild" and substitute therefor -- yield -- col. 3, Table II, delete "0.060 + 0.125 Co" and substitute therefor -- 0.06C+0.125 Co -- col. 3, Table II, delete "0.5 Ti + 0.1 Zr + 0.05C"

and substitute therefor

-- 0.5 Ti+0.1 Zr+ 0.05C -- col. 3, Table II, place a space before and a space after the grouping "1.25 Ta; 0.5 Ti;0.1Zr; 0.125 Fe;1.5MgO; 0.5 Ti+0.1Zr+0.1C"

Signed and Sealed this

Ninth Day of February 1982

[SEAL]

Attest:

GERALD J. MOSSINGHOFF

Attesting Officer

Commissioner of Patents and Trademarks